United States Patent [19]

Karam

[11] 4,207,981

[45] Jun. 17, 1980

[54] CONTAINER

[76] Inventor: Johnson D. Karam, 12744 Bassett St., North Hollywood, Calif. 91605

[21] Appl. No.: 31,523

[22] Filed: Apr. 19, 1979

[51] Int. Cl.[2] ..... B65D 23/08

[52] U.S. Cl. ..... 206/457; 215/12 R; 215/31

[58] Field of Search ..... 215/31, 12 R, 365, 1 R; 206/457, 459

[56] References Cited

U.S. PATENT DOCUMENTS

| | | | |
|---|---|---|---|
| 536,928 | 4/1895 | Hageboeck | 215/12 R |
| 540,697 | 6/1895 | Shulin | 206/457 X |
| 723,210 | 3/1903 | Richardson | 215/365 |

*Primary Examiner*—Donald F. Norton
*Attorney, Agent, or Firm*—Christie, Parker & Hale

[57] ABSTRACT

A "gag" and party item is provided to bring laughter and merriment to any party or other festive occasion. A glass bottle is provided having a colored liquid contained within. The colored liquid is to simulate an alcoholic beverage such as whiskey, wine, liqueur, or the like. There is provided in the neck of such a bottle a clear seal of glass or other material which prevents the pouring of the liquid from the bottle. The seal is located in the neck far enough from the opening of the bottle to substantially preclude detection when the contents of the bottle are viewed from the open end. A cap or cork or other closure device is provided for closing the outlet of the bottle. A label is provided on the neck portion of the bottle substantially surrounding the entire neck portion to substantially preclude visible detection of the seal.

10 Claims, 2 Drawing Figures

CONTAINER

BACKGROUND OF THE INVENTION

This invention relates to a container for use as a "gag" item to bring fun and merriment to any party or other festive occasion. The container has a liquid contained therein and such liquid cannot be poured from the container because a transparent seal located in the neck of the container blocks the flow of liquid therefrom. The construction of the container provides for substantially precluding visible detection of the seal.

Although containers are provided in the prior art having necks with seals affixed therein, it is not believed that containers are provided having the construction of the instant invention.

U.S. Pat. No. 860,337 issued to F. F. Schwede discloses a bottle having a glass plug inserted in the neck. The plug, however, does not prevent the liquid from pouring from the bottle. In fact, the plug is designed to allow the contents of the bottle to be poured very slowly therefrom. The shape and size of the plug render the plug incapable of completely stopping the liquid from flowing from the bottle.

U.S. Pat. No. 2,126,160 issued to R. Wishon discloses a container having a breakable neck portion. When the neck of the container is broken, the upper portion of the neck together with an upper cork is thrown away and a lower cork remains in the neck which can be removed by a corkscrew. There is no substantially permanent seal provided in the neck of the bottle, and the lower cork is not designed to be precluded from visible detection. In fact, the lower cork is to be found and removed so that the contents can be poured from the bottle.

U.S. Pat. No. 3,419,172 issued to H. O. Lee relates to a closure system for containers. The container is hermetically sealed when it is filled, and there is a means provided specifically for breaking such a seal. The seal provided is, therefore, not designed to be permanent and, in fact, is designed to be broken prior to the use of the container so that the fluid can be dispensed therefrom.

In addition, the seal is shown as being a short distance below the cap. When the cap is removed, the seal is therefore readily visible and there are no means provided to preclude visible detection of such a seal.

It is, therefore, believed that the prior art does not disclose a container of the construction of the instant invention.

SUMMARY OF THE INVENTION

A container is provided having a liquid contained therein. The container comprises a hollow body portion and a neck portion. The neck portion has a first end and a second end. The first end of the neck portion is attached to the hollow body portion, and the second end of the neck portion is remote from such a hollow body portion. A means is provided for closing the second end and a substantially transparent seal is provided within the neck portion of the container. The seal prevents the liquid from being dispensed from the container when the means for closing the second end is removed therefrom. In addition, a means is provided for substantially precluding visible detection of the seal.

BRIEF DESCRIPTION OF THE DRAWINGS

These and other aspects of the invention will be more fully understood by referring to the following detailed description and accompanying drawings in which.

DETAILED DESCRIPTION

Figure 1:
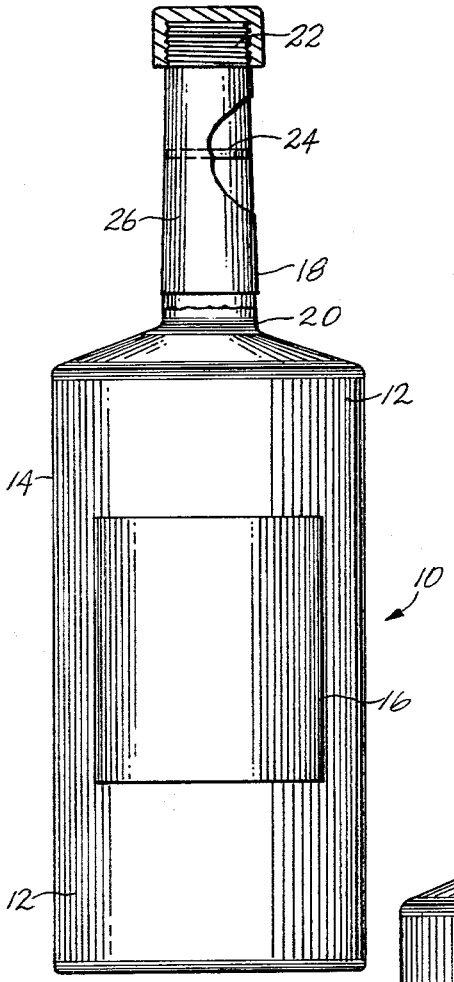
FIG. 1 is an elevational view of a container embodying principles of the present invention.
Figure 2:
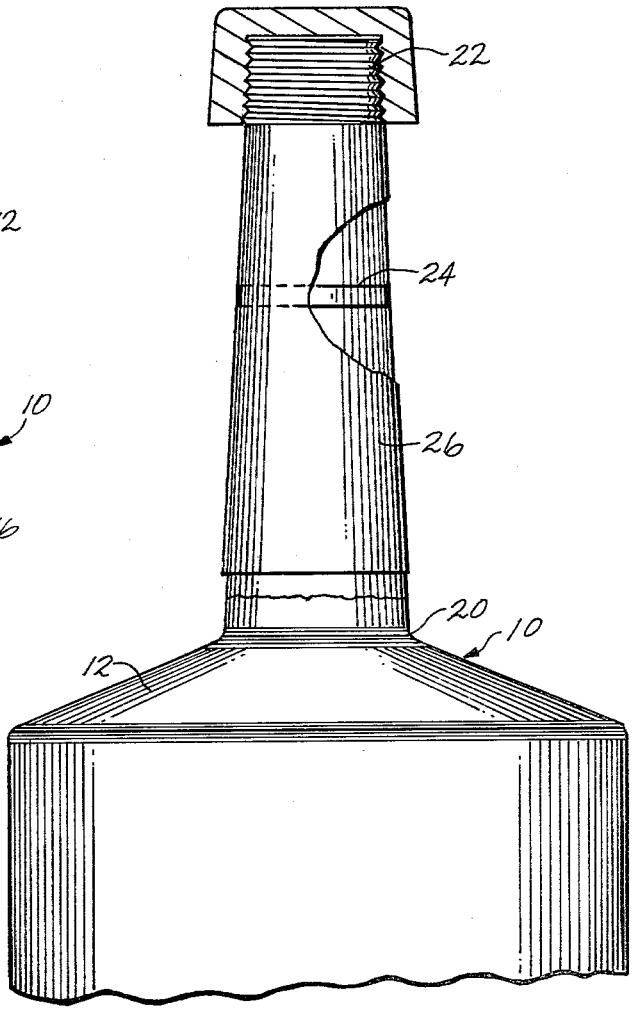
FIG. 2 is a fragmentary elevational view showing an enlarged section of the neck portion of the container of FIG. 1.

Referring to FIGS. 1 and 2, there is shown a container 10 with a liquid 12 contained therein. It is preferred that the container 10 be made of a substantially transparent material such as glass or a clear plastic or the like. In the present embodiment the container is made of clear, transparent glass which can be tinted various colors to simulate containers in which alcoholic beverages are supplied. The liquid 12 is colored to simulate an alcoholic beverage or the like.

Although it is not envisioned that the liquid will be ingested, the liquid provided is harmless and can be ingested without ill effect. For example, the liquid can be water which is colored to simulate whiskey, wine, a liqueur or other like alcoholic beverage. If the bottle is tinted sufficiently, it can be unnecessary to tint the liquid to simulate an alcoholic beverage and, therefore, plain water can be used.

The container comprises a hollow body portion 14. The hollow body portion can be substantially plain in design or can be etched or shaped for providing a substantially impressive, fancy container. The container can be provided, for example, with a design which would simulate a rare and expensive whiskey, wine, liqueur or other alcoholic beverage bottle.

A label 16 can be affixed to the hollow body portion of the container to identify this "gag" item as a rare whiskey or rare wine or other like rare and expensive alcoholic beverage. The container has a neck portion 18 having a first end 20 and a second end 22. The first end 20 is attached to the hollow body portion and the second end is the outlet of the bottle and is remote from such a hollow body portion.

A means is provided for closing the second end. The means for closing the second end, for example, can be a cork or the like inserted into such a second end. Alternatively, the means for closing the second end can be a cap. When a cap is used, the neck portion at the second end can be threaded for engagement of such a cap and the cap can also have threads for engagement of the threaded portion of the neck. The cap can, therefore, be twisted onto the threads of the neck, thereby engaging the threads of the neck and closing the container.

A substantially transparent seal 24 is provided within the neck portion for preventing the liquid from being dispensed from the container. The seal is designed to be a permanent seal, and it is preferred that the seal remain intact for the lifetime of the container. It is preferred that a container is provided having a neck portion that is greater than about two inches in length. It is preferred that the seal be located at least about two inches from the second end of the neck portion of the container within such a neck portion of the container. It is important that the seal is so located to inhibit detection of the seal when the cap is removed and the contents of the container are viewed through the open second end of the neck portion of such a container.

The seal, for example, can be made of transparent glass or plastic. The seal can be placed into the neck portion and affixed to such neck portion using an adhesive or the like. The adhesive, for example, will bond the seal to the neck portion entirely around the circumference of such a seal. Alternatively, the seal can be made integral with the container, i.e, the seal can be made at the same time as the container and as part of such container. It should be noted that other methods can also be used for permanently placing the seal in the neck portion of the container as, for example, by pressure fitting the seal into a tapered neck portion of such a container, and other such methods. The seal, therefore, is a hermetic seal keeping the air out of the container and precluding the liquid from being poured therefrom.

It should be noted that it can be desirable to provide the transparent seal tinted the same color as the liquid in the bottle. Alternatively, it may be desirable to provide an untinted seal as is provided by a water-clear glass or plastic seal or the like.

Further, there is provided a means for substantially precluding the visible detection of such a seal.

The container can be used as a "gag" or party item. It is intended, for example, that the container be given to a friend or acquaintance as a gift under the guise of being a rare whiskey or rare vintage wine. Instructions are given to the friend, for example, indicating that such a valuable and rare beverage be imbibed on festive occasions, perhaps at a Christmas party, a New Year's Eve party or other like occasion. It is envisioned that on such occasion the individual who has received the gift item might announce to one and all that it is time to open this most expensive and rare beverage for consumption. The cap or cork or other closure means can then be removed from the container and, as the bottle is up-ended to pour the beverage therefrom all are amazed that no liquid pours forth from the container. The cause of the lack of flow of liquid will not be readily apparent even as the container is studied and the contents of the container are viewed through the neck portion of such container. The individual viewing the contents of the bottle through the open neck portion will not be able to see the clear seal which is located at least about two inches from the second end of the neck. In addition, there is also provided a means for substantially precluding visible detection of the seal when observing the container from a direction other than when looking in to the open neck portion.

The neck portion can, for example, have a painted design thereon or can be made substantially opaque, thereby substantially precluding visible detection of such a seal. It is preferred, however, that the means for substantially precluding visible detection of the seal be a label 26 affixed to the neck portion of the container. The label can be positioned on the neck portion substantially surrounding the entire neck portion so as to preclude the visible detection of the seal.

The novelty container used in the manner envisioned is a "gag" item and is fun to use at parties and other festive occasions, and is a useful item for creating levity and merriment.

What is claimed is:

1. A container, the container having a liquid contained therein, such a container comprising:

(a) a hollow body portion;

(b) a neck portion having a first end and a second end, the first end attached to the hollow body portion, the second end remote from such a hollow body portion;

(c) means for closing such second end;

(d) a substantially transparent seal within such neck portion for preventing the liquid from being dispensed from the container; and (e) means for substantially precluding visible detection of such a seal.

2. The container as claimed in claim 1 wherein the second end of the neck portion has a threaded section for engagement of a cap, and the means for closing such a second end is a cap engaged on such threaded section.

3. The container as claimed in claim 1 wherein the means for closing such second end is a cork, such a cork inserted into the second end of the neck portion.

4. The container as claimed in claim 1 wherein the substantially transparent seal is the same color as the liquid.

5. The container as claimed in claim 1 wherein the means for substantially precluding visible detection of the seal is a label affixed to the neck portion of such a container.

6. The container as claimed in claim 1 wherein the neck portion is substantially opaque, thereby providing the means for substantially precluding visible detection of such a seal.

7. The container as claimed in claim 1 wherein the neck portion has a painted design thereon, thereby providing the means for substantially precluding visible detection of such a seal.

8. The container as claimed in claim 1 wherein such a container has a neck portion at least about two inches in height wherein the substantially transparent seal is located at least about two inches from such second end.

9. The container as claimed in claim 1 wherein the hollow body portion and neck portion are made of substantially transparent glass.

10. A substantially transparent glass bottle, the glass bottle having a liquid contained therein, such a glass bottle comprising:

(a) a hollow body portion;

(b) a neck portion having a first end and a second end, the first end attached to the hollow body portion, the second end remote from such first end;

(c) a cap engaging the second end of such neck portion for closing such a second end;

(d) a substantially transparent seal located at least about two inches from such second end of the neck portion for preventing the liquid from being dispensed from the container; and (e) a label affixed to the neck portion for substantially precluding visible detection of the seal.

* * * * *